US006871850B1

(12) United States Patent
Lenkl

(10) Patent No.: US 6,871,850 B1
(45) Date of Patent: Mar. 29, 2005

(54) APPARATUS AND METHOD OF TENSIONING A FLAT WEB OF MATERIAL TO BE CONVEYED, BY MEANS OF A ROTARY SPEED DIFFERENCE

(75) Inventor: Johannes Lenkl, Eching (DE)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/030,374

(22) PCT Filed: May 5, 2000

(86) PCT No.: PCT/EP00/04061

§ 371 (c)(1),
(2), (4) Date: Dec. 31, 2001

(87) PCT Pub. No.: WO01/85588

PCT Pub. Date: Nov. 15, 2001

(51) Int. Cl.[7] ..... B65H 20/04
(52) U.S. Cl. ..... 271/182; 198/813; 198/788
(58) Field of Search ..... 198/813, 788, 198/577, 599; 271/182

(56) References Cited

U.S. PATENT DOCUMENTS 3,880,059 A * 4/1975 Brockmuller ..... 198/35
3,904,145 A * 9/1975 Steinberger et al. ..... 242/75.2
4,147,341 A * 4/1979 Wurscher et al. ..... 271/122
4,570,780 A * 2/1986 Thwaites et al. ..... 198/781
4,693,462 A * 9/1987 Pollich ..... 271/183
5,676,365 A * 10/1997 Pittelkow et al. ..... 271/125
5,921,546 A * 7/1999 Herman ..... 271/182
6,120,019 A * 9/2000 Kayser et al. ..... 271/182
6,231,041 B1 * 5/2001 Jacques ..... 271/182

FOREIGN PATENT DOCUMENTS

| | | |
|---|---|---|
| EP | 0 036 193 | 9/1981 |
| EP | 0 980 832 | 2/2000 |

OTHER PUBLICATIONS

International Search Report for PCT/EP00/04061, Dated Jan. 25, 2001.

* cited by examiner

*Primary Examiner*—Douglas Hess
(74) *Attorney, Agent, or Firm*—Christie, Parker & Hale, LLP

(57) ABSTRACT

The invention concerns an apparatus and a method of tensioning a flat web of material to be conveyed, in particular in a printing and dispensing device for labels, which includes: a drive for advancing and retracting the flat web of material, and at least one advance unit and at least one braking unit having a braking roller which are in contact with the web of material and which are drivable by the drive means. It is further provided that the drive has a drive motor that is drivingly connected to the advance unit and the braking unit and that, in a conveyor operation in the advance direction of the web of material, the braking roller of the braking unit is uncoupled from the drive motor.

9 Claims, 2 Drawing Sheets

Figure 1:
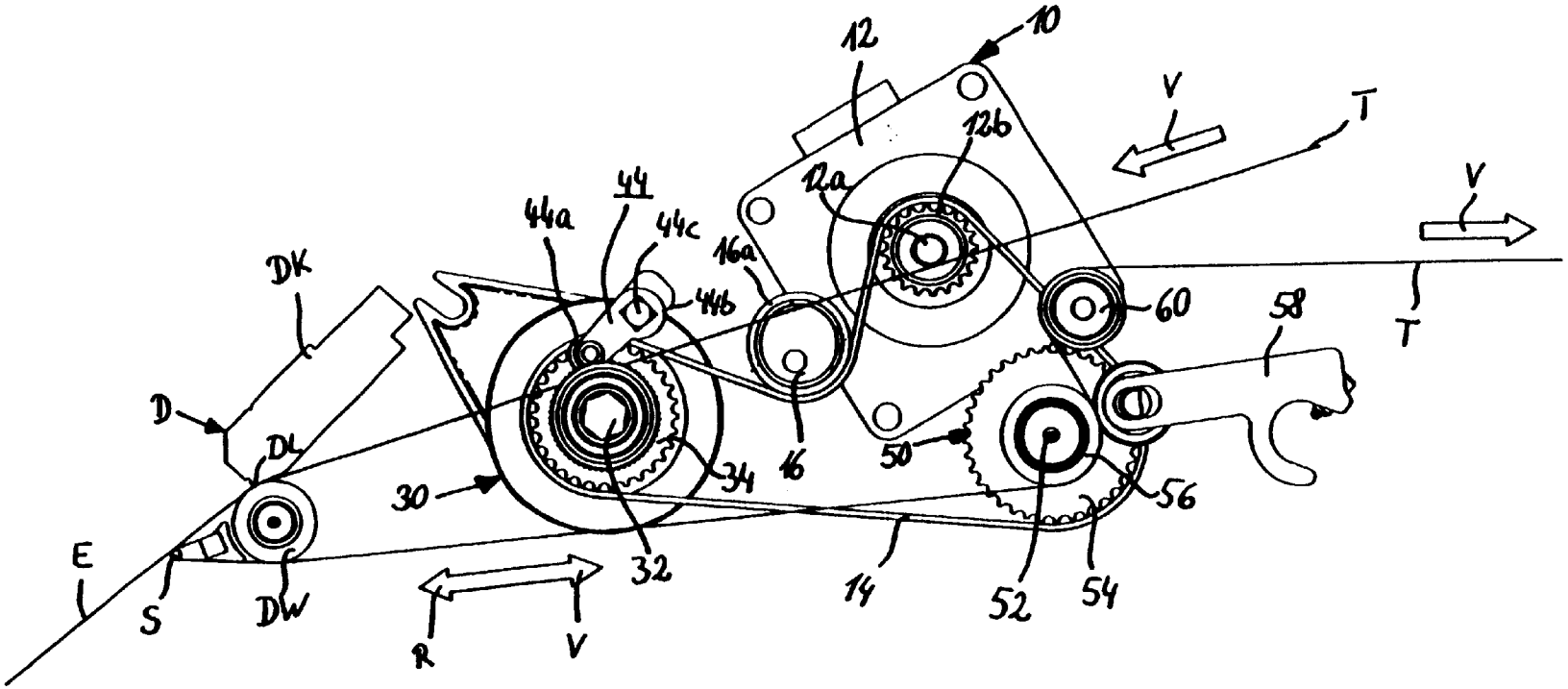

APPARATUS AND METHOD OF TENSIONING A FLAT WEB OF MATERIAL TO BE CONVEYED, BY MEANS OF A ROTARY SPEED DIFFERENCE

CROSS-REFERENCE TO RELATED APPLICATION

This application claims priority of International application number PCT/EP00/04061, filed May 5, 2000.

The present invention concerns an apparatus and a method of tensioning a flat web of material to be conveyed, in particular in a printing and dispensing device for labels, as set forth in the classifying portions of claims 1 and 6.

When conveying flat webs of material, a problem which frequently arises is that, within an item of equipment, a machine and so forth, after a conveying operation, the web of material must be positioned precisely with respect to a processing station such as for example a printing station or a stamping station. In order to occupy the precise position at any time, the web of material must be held virtually always taut or tensioned. In addition, it is frequently not sufficient for the web of material merely to be driven in the direction of advance movement, but the web of material must also be pulled back in the direction opposite to the direction of advance movement, either because the web of material has been advanced too far as a positioning error, or because the web of material has been pushed beyond a desired position, as a result of a processing step. Both when the web of material is being advanced and also when it is being pulled back, the demand for precise positioning makes it necessary for the web of material to be held in a tensioned condition or taut.

Furthermore, particularly in the case of dispensing devices for labels, it is necessary for the web of carrier or backing material on which the labels are arranged to be held in a taut condition. For discharging or dispensing the labels from the web of backing material, the latter is passed with a very small radius around the dispensing edge. As the web of backing material is more flexible than the respective label, in that situation the label comes away from the web of backing material. So that this functions reliably, it is necessary for the web of backing material to be held in a taut condition.

For that purpose, it is known in a practical context to provide an advance unit having an advance roller and a braking unit having a braking roller which is arranged upstream of the advance unit in the direction of advance movement of the flat web of material to be conveyed, and for the advance roller of the advance unit to be driven by way of a motor. In that arrangement, in the event of a conveying operation in the direction of advance movement of the web of material, the motor drives the advance roller which then pulls the web of backing material in the advance direction. At the same time, the braking roller applies a braking moment to the flat web of material which is to be conveyed. However, only a low braking force can be applied in order to avoid tearing the web of backing material. In the case of a conveyor operation in the opposite direction, the advance roller pushes the web of backing material, in which case however loops can be formed so that then in a conveyor operation in the advance direction, the web of backing material is no longer tensioned in a taut condition.

The object of the present invention is to provide an apparatus and a method of tensioning a flat web of material to be conveyed, of the kind set forth in the opening part of this specification, which permits tensioning of the web of material in a structurally simple and thus inexpensive manner.

In regard to the apparatus, the foregoing object is attained by the features of claim 1. Appendant claims 2 to 5 set forth advantageous configurations.

The possibility of having to provide only a single drive motor means that there is a considerable reduction in the structural complication for the apparatus according to the invention in comparison with the above-discussed known apparatus so that costs are also reduced. By virtue of uncoupling the braking roller from the drive connection to the drive motor, the braking roller can be acted upon by a braking force independently of the drive motor and independently of the advance unit. In that way, in accordance with the invention, the web of material can be held in a taut condition with simple means while the web is moving in the direction of advance movement.

In principle uncoupling of the braking roller from the drive motor can be effected by a separately actuated clutch. Such a design configuration however is also structurally complicated. It is therefore preferred that the diameter of the braking roller is larger than the diameter of the advance roller and that provided between the braking roller and the drive motor is a freewheel which, upon a conveying movement of the web of material in the advance direction thereof, uncouples the drive connection between the drive motor and the braking roller. As however the diameter of the braking roller is larger than the diameter of the advance roller and furthermore the web of material is in contact both with the braking roller and also with the advance roller, the braking roller rotates more slowly than the part of the freewheel which is drivingly connected to the drive motor so that this part of the freewheel 'overtakes' the braking roller. That causes the drive connection between the drive motor and the braking roller to be uncoupled. In that way a braking force can then be applied to the braking roller by suitable means so that the web of material can be held tensioned or taut.

If the web of material has to be pulled in the direction opposite to the direction of advance movement, the freewheel locks and produces a drive connection between the drive motor and the braking roller. In addition the larger diameter of the braking roller in relation to the diameter of the advance roller provides that the braking roller 'pulls' the web of material more strongly than the advance roller can push the web. That avoids the web of material forming loops, as a result of an advance unit which is only pushing.

In order to be able to apply a braking force to the braking roller, it is preferably possible to provide an adjustable braking device which includes in particular a brake disk and a compression spring. That braking device can then be suitably set from the exterior manually or automatically depending on the respective web of material to be conveyed.

So that entrainment of the braking roller by the web of material reliably takes place and so that in addition the web of material bears securely against the advance roller of the advance unit for transmission of the drive force, it can further be provided that the web of material can be pressed against the braking roller and/or an advance roller of the advance unit by means of at least one respective pressure-applying device.

The common drive of the drive motor for the advance unit and the braking unit can be formed by the most widely varying means, for example toothed wheels or gears. A simple and particularly inexpensive structure can be achieved by the drive motor driving the braking unit and the advance unit by way of a toothed belt.

In regard to the method, the foregoing object is attained by the features of claim 6. Appendant claims 7 to 9 set forth advantageous configurations.

The method according to the invention makes it possible in principle to attain the same advantages as have already been discussed hereinbefore in connection with the apparatus.

Figure 2:
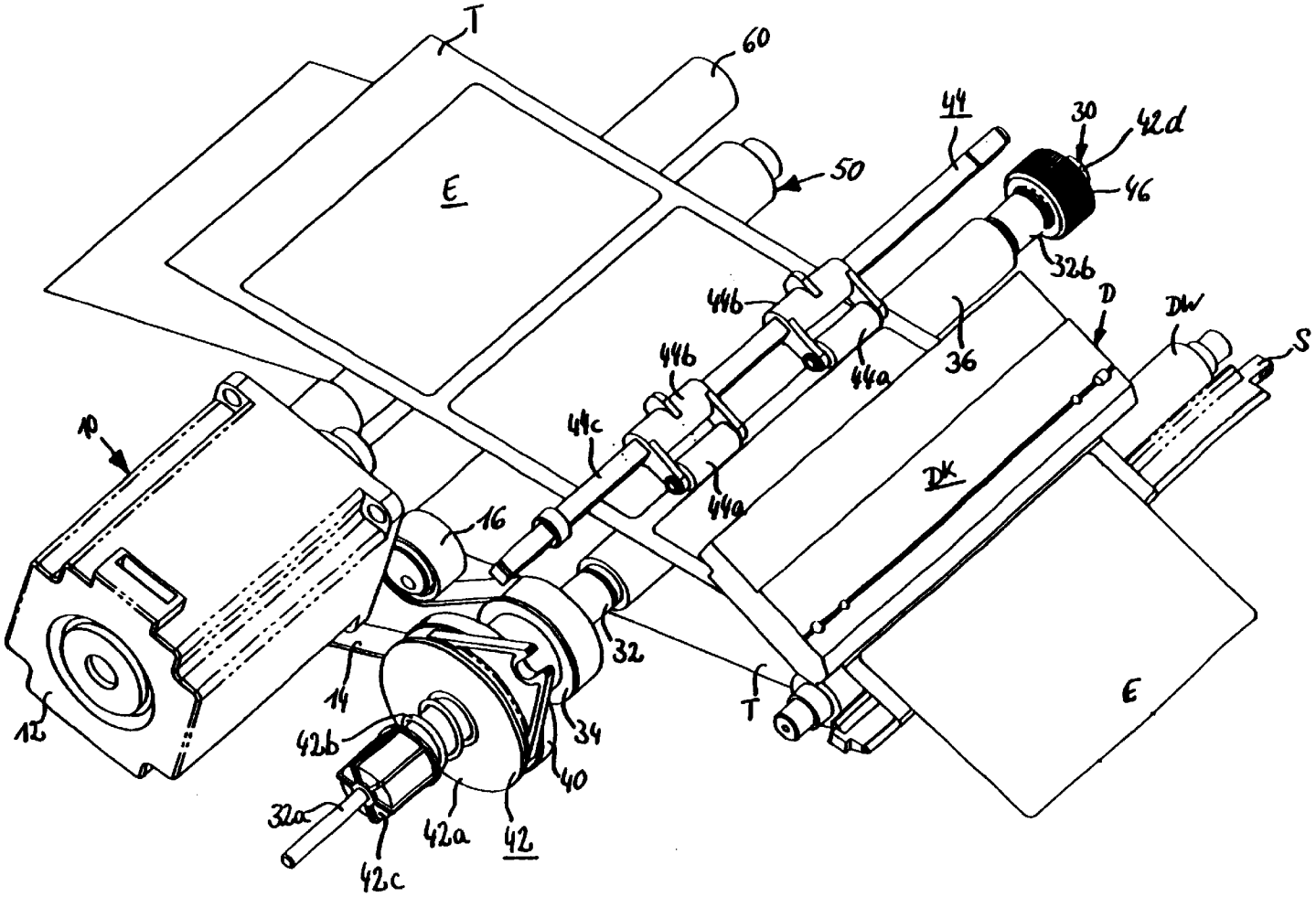

Further advantageous configurations and an embodiment by way of example of the apparatus according to the invention and the method according to the invention are described hereinafter with reference to the accompanying drawings. It is to be noted in this connection that the terms 'left', 'right', 'bottom' and 'top' used in the description relate to the drawings with the references in the position for normally reading them. In the drawings:

FIG. 1 is a diagrammatic side view of an apparatus according to the invention which is used in a printing and dispensing device for labels, and FIG. 2 is a perspective view from the front and from inclinedly above on to the apparatus shown in FIG. 1.

The apparatus according to the invention comprises the main structural units consisting of the drive means or drive unit 10, the braking unit 30 and the advance unit 50, and in the illustrated embodiment is used in a printing and dispensing device for labels E. As can be seen in particular from FIG. 2 the labels E are fitted on the top side of a web of material or a backing material web T symmetrically relative to the longitudinal center line thereof and at uniform spacings relative to each other.

In the printing and dispensing device the labels E are successively printed by means of a printing unit D which, in the direction of advance movement V of the backing material web T, is arranged downstream of the braking unit 30 and upstream of the advance unit 50. The printing unit D includes a printing head DK with a printing line DL which synchronously prints a line transversely with respect to the advance direction V of the backing material web T, and a printing roller DW. After the backing material web T with the labels E has been passed for the printing operation between the printing head DK and the printing roller DW of the printing unit D, the labels E are individually detached from the backing material web T at a dispensing edge S which is provided downstream of the printing unit D in the advance direction V of the backing material web T, and for being stuck for example on to a product, are discharged or dispensed from the printing and dispensing device. When the labels E have been detached from the backing material web T at the dispensing edge S, the backing material web T is passed by way of the advance unit 50 to a winding-on roller (not shown) for winding on the empty backing material web T.

As can be seen from a comparison between FIGS. 1 and 2, the spacing between the printing head DK or the printing line DL and the dispensing edge S in the advance direction V of the backing material web T is larger than the spacing of the individual labels E from each other in that direction V.

The drive unit 10 has an electric drive motor 12, a toothed belt 14 and a tensioning device 16 for the toothed belt 14. The drive motor 12 which is supported on a frame (not shown) of the printing and dispensing device has a horizontally extending drive shaft 12*a* and a toothed pulley 12*b* which is arranged non-rotatably and axially fixedly on the drive shaft 12*a* and which is in engagement with the toothed belt 14. As can be seen from FIG. 1 the drive motor 12 is upstream of the braking unit 30 in the advance direction V of the backing material web T and the drive shaft 12*a* extends above the backing material web T. Provided between the drive motor 10 and the braking unit 30 is the tensioning device 16 which comprises a rotatably mounted and possibly spring-loaded tensioning roller 16*a*. The tensioning roller 16*a* is disposed above the toothed belt 14 which extends around the tensioning roller 16*a* over an angle of about 90° and presses same possibly adjustably downwardly, whereby the toothed belt 14 is tensioned.

The braking unit 30 has a horizontally extending shaft 32 which is mounted on the frame of the printing and dispensing device, and a toothed pulley 34 which is arranged on the shaft 32 and which also comes into engagement with the toothed belt 14. A braking roller 36 is non-rotatably and axially immovably fitted on the drive shaft 32. The braking roller 36 is in at least approximately tangential contact with the underside of the backing material web 2 and can possibly have a friction-increasing coating or can be made from such a material. As can be seen from FIGS. 1 and 2, the toothed pulley 34 whose diameter is larger than the diameter of the braking roller 36 has the toothed belt 14 passing therearound over an angle of greater than 180°.

The braking device 42 has a brake disk 42*a*, a compression spring 42*b*, a braking force adjusting knob 42*d* accessible from the exterior and non-rotatably and axially fixedly connected to a screwthreaded rod 32*a* which extends axially through the shaft 32 in the form of a hollow shaft, and a pressure cap 42*c* which is screwed by way of its female screwthread on to the screwthreaded rod 32*a*. The brake disk is arranged non-rotatably but axially displaceably on the shaft 32 whereas the compression spring 42*b* is pushed coaxially on to the shaft 32 (see FIG. 2). The compression spring 42*b* bears on the one hand against the brake disk 42*a* and on the other hand against the pressure cap 42*c*. By rotating the braking force adjusting knob 42*d*, it is possible to adjust the pressure of the compression spring 42*b* on the brake disk 42*a* and thus the braking force, depending on the respective backing material web T to be conveyed.

In addition the braking unit 30 has a pressure-applying device 44 which is arranged in a plane which passes through the axis of the shaft 32 and which extends downwardly, above the braking roller 36. The pressure-applying device 44 includes two pressure-applying rollers 44*a* which are in contact with the top side (=label side) of the backing material web T and which are held by way of carrier devices 44*b* to a bar 44*c* which is of square cross-section and which extends horizontally and parallel to the shaft 32. The bar 44*c* is also mounted on the frame of the printing and dispensing device. As can be seen in particular from FIG. 2 the pressure-applying rollers 44*b* which possibly have a friction-increasing coating or which can be made from such a material are held by way of the carrier devices 44*b* to the bar 44*c* in such a way that they are disposed downstream of the bar 44*c* in the advance direction V of the backing material web T. The pressure-applying rollers 44*a* press the backing material web T against the braking roller 36, in which respect for that purpose they can possibly be additionally loaded by spring means and the like. For the purposes of adaptation to material webs T of different widths, the pressure-applying rollers 44*a* are adjustable in their axial position on the bar 44*c*.

It is also to be noted that provided at the right-hand end 32*b* of the shaft 32 is a rotary knob 46 which is connected non-rotatably and axially fixedly to the shaft 32 and by means of which the shaft 32 can be turned by hand.

The advance unit 50 also has a horizontally extending shaft 52 which is in turn mounted rotatably on the frame of the printing and dispensing device, and a toothed pulley 54 which is arranged non-rotatably and axially fixed on the shaft 52. The toothed pulley 54 is arranged on the side facing towards the drive motor 10 and is also in engagement with the toothed belt 14 which passes around the toothed pulley 54 over an angle of greater than 90° and less than 180°. An advance roller 56 is arranged non-rotatably and axially fixedly on the shaft 52 and can possibly have a friction-increasing coating or can be made from such a material. The advance roller 56 whose diameter is smaller than the diameter of the braking roller 36 is in contact with the underside of the backing material web T over an angle of greater than 90° and less than 180°. The backing material web T is pressed against the peripheral surface of the advance roller 56 by means of a further pressure-applying device 58 which acts on the top side of the backing material web T and which can be of substantially the same structure as the pressure-applying device 44 of the braking unit 30.

Provided downstream of and above the advance unit 50, in the advance direction V of the backing material web T, is a direction-changing roller 60 which is supported rotatably on the frame of the printing and dispensing device. The direction-changing roller 60 comes into contact with the top side of the backing material web T and has same passing therearound over an angle of greater than 90° and less than 180°.

It should also be noted that the width of the backing material web T is at a maximum equal to the width of the printing head DK, the printing roller DW, the braking roller 36, the advance roller 56 and/or the direction-changing roller 60.

The mode of operation of the apparatus according to the invention and the method according to the invention will now be described:

In an initial position an unprinted label E of the backing material web T is disposed beneath the printing head DK in such a way that it is aligned with respect to the printing line DL, for the first line to be printed. The backing material web T has previously been drawn off a supply roll (not shown), and passed through between the pressure-applying rollers 44a and the braking roller 36 and between the printing head DK and the printing roller DW. In addition, a label-less leader end of the backing material web T was passed from the printing unit D around the dispensing edge S, between the advance roller 56 and the pressure-applying device 58, around the direction-changing roller 60, and to a winding-on roll (also not shown) for the empty backing material web T.

If a new label E is to be delivered or dispensed, then firstly printing is applied, possibly in a plurality of lines, to the label E which is at that moment beneath the printing head DK or the printing line DL. For that purpose the backing material web T is advanced possibly in a stepwise manner, for which purpose the drive motor 12 is supplied with power for rotation in the counter-clockwise direction. In that way, both the toothed pulley 34 of the braking unit 30 and also the toothed pulley 54 of the advance unit 50 are driven also in the counter-clockwise direction by way of the toothed belt 14. As the backing material web T is pressed by way of the pressure-applying device 58 against the advance roller 56 of the advance unit 50, the advance roller 56 entrains the backing material web T in the advance direction V. If now the braking roller 36 of the braking unit 30 were of the same diameter as the advance roller 56, the braking roller 36 would rotate at the same speed as the advance roller 56 (apart from influences due to slip) so that a braking force cannot be applied to the backing material web T by the braking unit 30 independently of the drive unit 10, whereby the backing material web T cannot be held in a tensioned or taut condition during the advance movement. As however the diameter of the braking roller 36 is larger than the diameter of the advance roller 56, the speed of rotation of the advance roller 56 is higher than the speed of rotation of the braking roller 36. As moreover the freewheel 40 is provided between the braking roller 36 and the toothed pulley 34, the toothed pulley 34 'overtakes' the braking roller 36. As a result of the contact of the braking roller 36 with the backing material web T which is driven or pulled by the advance roller 56, the braking roller 36 moves in the counter-clockwise direction independently of the permanent drive connection from the drive motor 12 and the toothed pulley 34 and thus independently of the drive force of the drive motor 10. In that way a braking force can now be applied by the braking device 42 to the braking roller 36 and thus to the backing material web T so that the backing material web T is held taut by the braking unit 30.

After the termination of the printing operation the printed label E together with the backing material web T is further advanced or pulled to the dispensing edge S, possibly continuously, by the advance unit 50 (depending on the respective spacing between the printing unit D and the dispensing edge S or depending on the length of the labels E, the label E can also already reach the dispensing edge S during the printing operation). There, the label E which has just been printed upon is detached from the backing material web T. The backing material web T is further drawn by the advance unit 50 in the advance direction V of the backing material web T until the label E is completely detached from the backing material web T. The label E can then be passed on for further processing.

As the intermediate spacings of the individual labels E from each other in the advance direction V of the backing material web T is less than the spacing between the printing line DL of the printing unit D and the dispensing edge S, the next label E which is still unprinted has at least partially already moved past the printing line DL. So that this label E can again be arranged precisely under the printing line DL, the backing material web T must be pulled back in the retraction direction R which is opposite to the advance direction V (see the double-headed arrow R/V in FIG. 1). For that purpose the drive motor 12 is supplied with power for rotation thereof in the clockwise direction. The toothed pulleys 34 and 54 of the braking and advance units 30 and 50 respectively are also caused to rotate in the clockwise direction by way of the toothed belt 14. As the freewheel 40 is in a locking condition in that direction, a drive connection is made between the toothed pulley 34 and the braking roller 56. In that way, the braking roller 36 can pull the backing material web T which is clamped between it and the pressure-applying device 54, in the retraction direction R, in which case the advance unit 50 can also push the backing material web T in the retraction direction R. As however the diameter of the braking roller 36 is larger than the diameter of the advance roller 56, the braking roller 36 'pulls' the backing material web more strongly than the advance roller 56 pushes it, thereby avoiding loop formation by virtue of the advance unit 50 which otherwise alone pushes the backing material web T. In other words, in this case the braking unit 30 implements the 'advance' of the backing material web T.

It is to be noted in this connection that it would in principle also be possible for the advance unit 50 also to have a freewheel which in the retraction direction R interrupts the drive connection between the toothed pulley 54 and the advance roller 56.

As soon as the unprinted label e has reached the correct position with respect to the printing line DL, the drive motor 12 is switched off and the printing and dispensing device is ready for a fresh issue of a label E.

What is claimed is:

1. An apparatus for tensioning a flat web of material to be conveyed, in particular in a printing and dispensing device for labels, comprising:

drive means for advancing and pulling back the flat web of material (T), and at least one advance unit drivable by the drive means and at least one braking unit with at least one braking roller which are in contact with the web of material (T), wherein the drive means are also drivingly connected to the braking unit, and that wherein in a conveyor operation in the advance direction of the web of material, the braking roller of the braking unit is uncoupled from a drive motor.

2. An apparatus as set forth in claim 1 wherein the diameter of the braking roller is larger than the diameter of an advance roller of the advance unit, and wherein a flywheel is provided between the braking roller and the drive motor, which in a conveyor operation in the advance direction of the web of material, uncouples the drive connection between the drive motor and the braking roller.

3. An apparatus as set forth in claim 1 or claim 2 wherein the braking roller has an adjustable braking device which includes a brake disk and a compression spring.

4. An apparatus as set forth in claim 1 wherein the web of material can be pressed against the braking roller and/or an advance roller of the advance unit by means of at least one respective pressure-applying device.

5. An apparatus as set forth in claim 1 wherein the drive motor drives the braking unit and the advance unit by way of a toothed belt.

6. A method of tensioning a flat web of material to be conveyed, in particular in a printing and dispensing device for labels, wherein the web of material is passed by way of at least one braking unit having at least one braking roller and at least one advance unit which is drivable by drive means in an advance and retraction direction of the web of material, characterised in that the drive means are drivingly connected to the braking unit and that in a conveyor operation in the advance direction of the web of material the braking roller of the braking unit is uncoupled from a drive motor.

7. A method as set forth in claim 6 wherein the web of material is pressed against the braking roller and/or the drive roller of the advance unit.

8. A method of tensioning a flat web of material to be conveyed, in particular in a printing and dispensing device for labels, wherein the web of material is passed by way of at least one braking unit having at least one braking roller and at least one advance unit which is drivable by drive means in an advance and retraction direction of the web of material, characterised in that the drive means is drivingly connected to the braking unit and that in a conveyor operation in the advance direction of the web of material the braking roller of the braking unit is uncoupled from a drive motor; and characterised in that uncoupling of the braking roller from the drive motor is effected necessarily in dependence on the conveyor direction of the web of material.

9. A method as set forth in claim 6 or claim 8 wherein a braking force which is preferably adjustable is applied to the braking roller by way of a braking device.

* * * * *